US011125452B2

(12) United States Patent
Qin

(10) Patent No.: US 11,125,452 B2
(45) Date of Patent: Sep. 21, 2021

(54) SUBMERSIBLE-TYPE HUMIDIFIER THAT ADDING WATER FROM UPPER PORTION

(71) Applicant: Yong Qin, Foshan (CN)

(72) Inventor: Yong Qin, Foshan (CN)

( * ) Notice: Subject to any disclaimer, the term of this patent is extended or adjusted under 35 U.S.C. 154(b) by 0 days.

(21) Appl. No.: 17/018,908

(22) Filed: Sep. 11, 2020

(65) Prior Publication Data

US 2021/0071884 A1 Mar. 11, 2021

(30) Foreign Application Priority Data

Sep. 11, 2019 (CN) ..... 201921515427.X

(51) Int. Cl.
*F24F 6/12* (2006.01)
*F24F 6/00* (2006.01)

(52) U.S. Cl.
CPC ..... *F24F 6/12* (2013.01); *F24F 6/00* (2013.01); *F24F 2006/008* (2013.01)

(58) Field of Classification Search
CPC ..... F24F 6/12; F24F 6/02; F24F 13/00; F24F 13/20; F24F 2006/008; F24F 6/00; B05B 17/06; Y02B 30/80
See application file for complete search history.

(56) References Cited

U.S. PATENT DOCUMENTS

2014/0326802 A1* 11/2014 Ljuhar ..... B05B 17/0615 239/102.2
2015/0153058 A1* 6/2015 Chen ..... F24F 11/79 261/129
2016/0175757 A1* 6/2016 Yoon ..... B01D 47/18 261/30
2016/0356514 A1* 12/2016 Cai ..... F24F 11/0008
2017/0122586 A1* 5/2017 Son ..... F24F 13/20
2017/0122588 A1* 5/2017 Lee ..... F24F 6/14
2017/0153040 A1* 6/2017 Wang ..... F24F 13/28
2017/0227243 A1* 8/2017 Thomas ..... F24F 11/62
(Continued)

FOREIGN PATENT DOCUMENTS

CN 106895537 * 6/2017

OTHER PUBLICATIONS

Epo translation of CN 106895537 (Year: 2017).*

*Primary Examiner* — Stephen Hobson
(74) *Attorney, Agent, or Firm* — Muncy, Geissler, Olds and Lowe, P.C.

(57) ABSTRACT

The invention relates to a submersible-type humidifier that adding water from upper portion, comprising a lower water tank and a top cover connected thereto, the lower water tank and the top cover are detachably connected, an electric appliance chamber is arranged in inner chamber of the top cover, an air blower and a display control panel are arranged inside the electric appliance chamber, an energy gathering atomization pipe is provided on bottom of the top cover, an ventilation portion is provided on outer side of the energy gathering atomization pipe, air blower is connected to the ventilation portion, inner chamber of the energy gathering atomization pipe is respectively connected with the ventilation portion and mist outlet of the top cover, an atomization component is provided on bottom of the energy gathering atomization pipe, the atomization component and the air blower are respectively electrically connected to the display control panel.

6 Claims, 4 Drawing Sheets

(56) References Cited

U.S. PATENT DOCUMENTS

| | | | | |
|---|---|---|---|---|
| 2017/0304861 | A1* | 10/2017 | Seo | F24F 6/16 |
| 2019/0041084 | A1* | 2/2019 | Atkins, Jr. | F24F 6/00 |
| 2019/0041086 | A1* | 2/2019 | Atkins, Jr. | F24F 6/12 |
| 2019/0226698 | A1* | 7/2019 | Kim | F24F 13/20 |
| 2020/0096213 | A1* | 3/2020 | Liang | F24F 6/12 |

* cited by examiner

SUBMERSIBLE-TYPE HUMIDIFIER THAT ADDING WATER FROM UPPER PORTION

BACKGROUND OF THE INVENTION

1. Field of the Invention

The invention relates to the technical field of humidifiers, in particular to a submersible-type humidifier that adding water from upper portion.

2. Background Art

With the strengthening of health orientation in recent years, humidifiers have been widely used in household life as a device that imparts appropriate humidity to indoor air, and the prior humidifier structure generally arranges electrical components such as control devices and atomization device on base below the humidifier water tank, and waterproof treatment is required between the water tank and the base, which increases production costs, moreover, long-term use may also cause water leakage and cause damage to the humidifier.

Therefore, the prior art needs further improvement.

SUMMARY OF THE INVENTION

The invention aims to overcome the deficiencies in the prior art by providing a submersible-type humidifier that adding water from upper portion, and to solve one of the above technical problems in the prior art to a certain extent.

The invention is realized by following technical schemes:

A submersible-type humidifier that adding water from upper portion, comprising a lower water tank and a top cover connected thereto, the lower water tank and the top cover are detachably connected, wherein an electric appliance chamber used for assembling electrical components is arranged in inner chamber of the top cover, an air blower and a display control panel are arranged inside the electric appliance chamber, an energy gathering atomization pipe is provided on bottom of the top cover, an ventilation portion is provided on outer side of the energy gathering atomization pipe, the air blower is connected to the ventilation portion, an inner chamber of the energy gathering atomization pipe is respectively connected with the ventilation portion and mist outlet of the top cover, an atomization component is provided on bottom of the energy gathering atomization pipe, the atomization component and the air blower are respectively electrically connected to the display control panel.

An air inlet connected to the air blower is provide on top of the ventilation portion, and an airflow guide slope is provided on bottom of the ventilation portion.

An energy gathering floater is arranged in the inner chamber of the energy gathering atomization pipe, and a mist gathering through hole is arranged at the center of the energy gathering floater.

Multiple reinforcement ribs are provided on outer lateral wall of the mist gathering through hole.

A bell mouth connected to the energy gathering atomization pipe is provided on the top cover, the width of the bell mouth increases from bottom to top, a mist outlet cover is provided on upper end of the top cover, the mist outlet cover is connected to the bell mouth, an energy gathering ring is provided on bottom of the mist outlet cover, and the energy gathering ring is in an arc shape with downward opening, a mist outlet gap is formed between the energy gathering ring and the bell mouth, the mist outlet is arranged on top of the mist outlet cover and is connected with the mist outlet gap.

A shunt ring is provided at the center of lower end of the energy gathering ring, and multiple shunt holes are provided on the shunt ring.

The lower water tank and the top cover are both in the shape of cylinder.

The lower water tank and the top cover are both in the shape of cube.

The advantageous effects of the invention are as follows:

The air blower and the display control panel are arranged in the electric appliance chamber of the top cover to avoid water leakage from the inside of the lower water tank to the inside of the electric appliance chamber, and additional waterproofing work is not required between the top cover and the lower water tank, which reduces the production cost, the lower water tank can be fed with water or washed directly by opening the top cover, and the invention is convenient and also durable.

The additional aspects and advantages of the invention will become apparent in the following description, or be understood through the practice of the invention.

DETAILED DESCRIPTION OF THE PREFERRED EMBODIMENTS

The invention will be further described below with reference to the drawings and embodiments.

Embodiment 1

Figure 1:
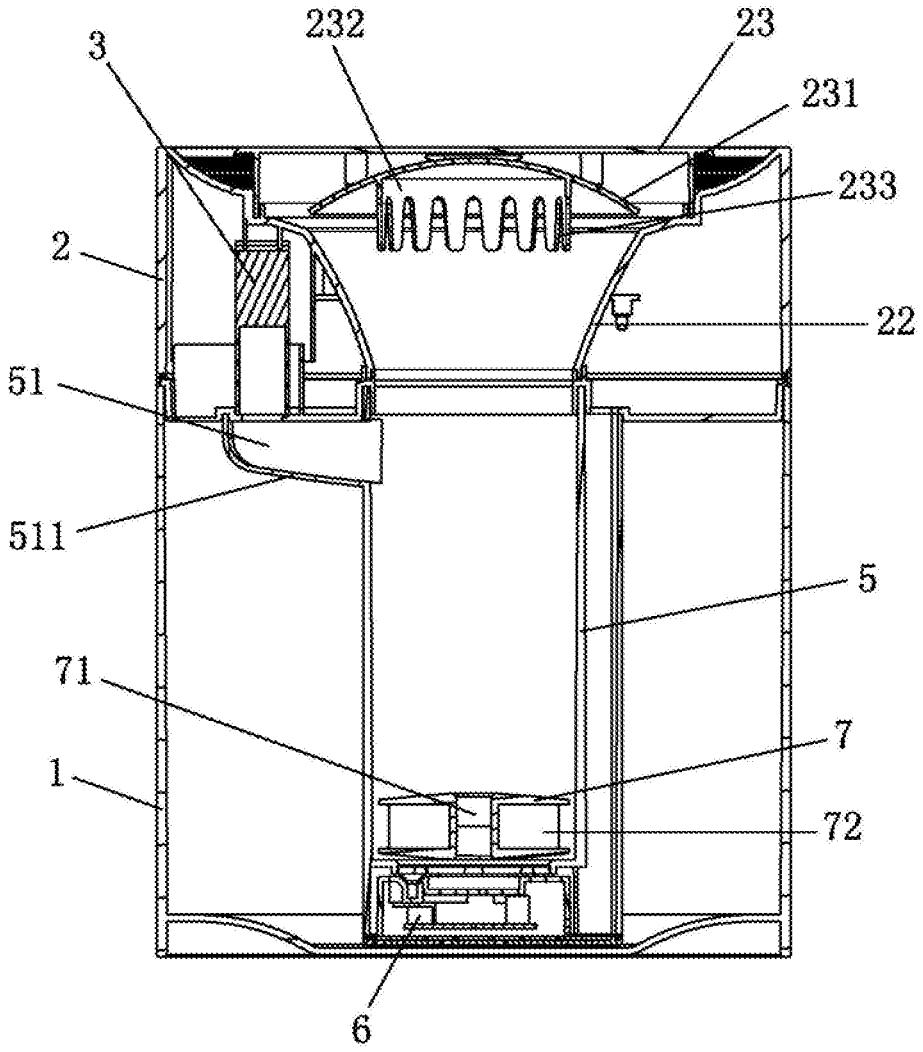
FIG. 1 is the section view of embodiment 1 in the invention.
Figure 2:
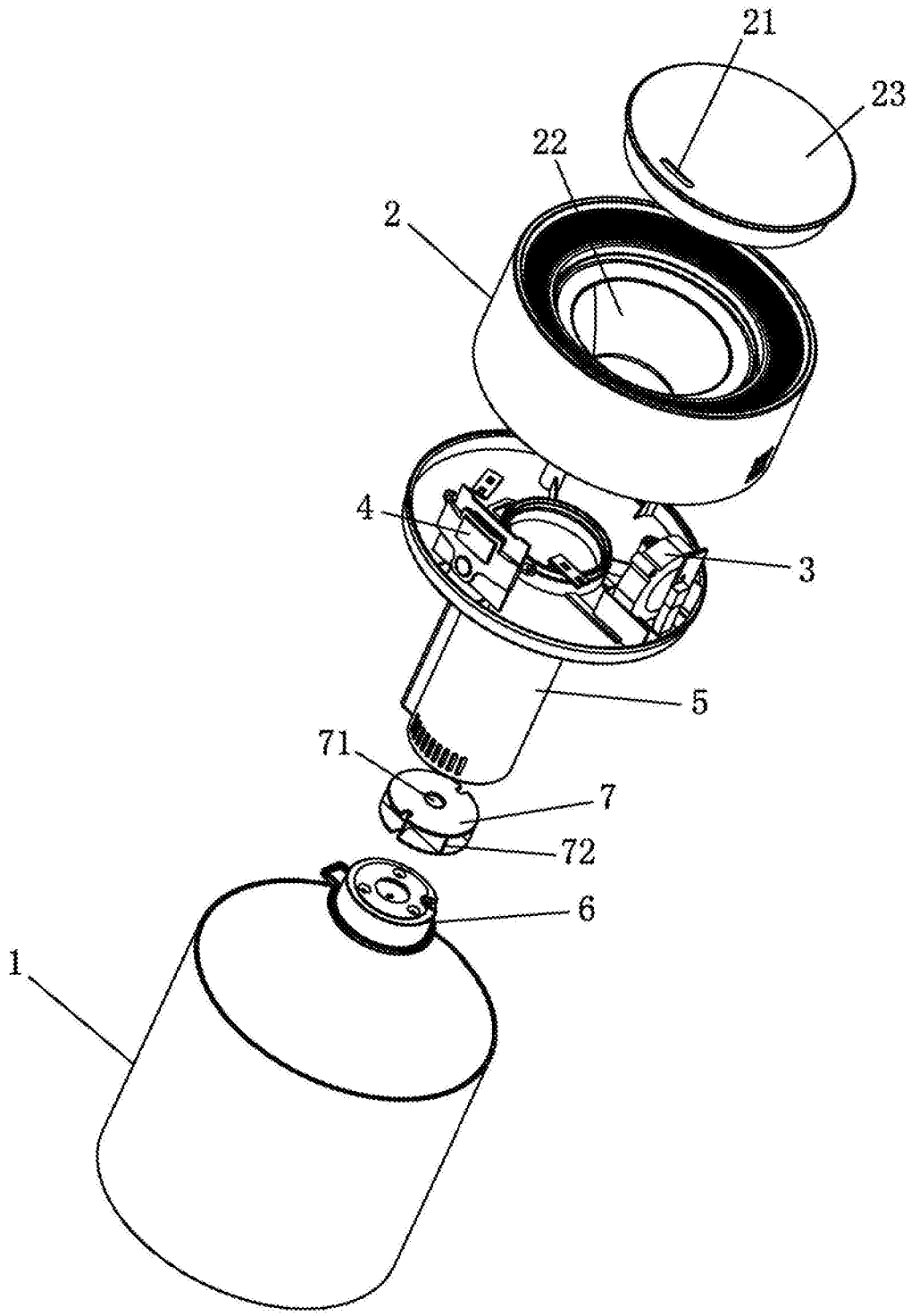
FIG. 2 is the exploded view of embodiment 1 in the invention.
Figure 3:
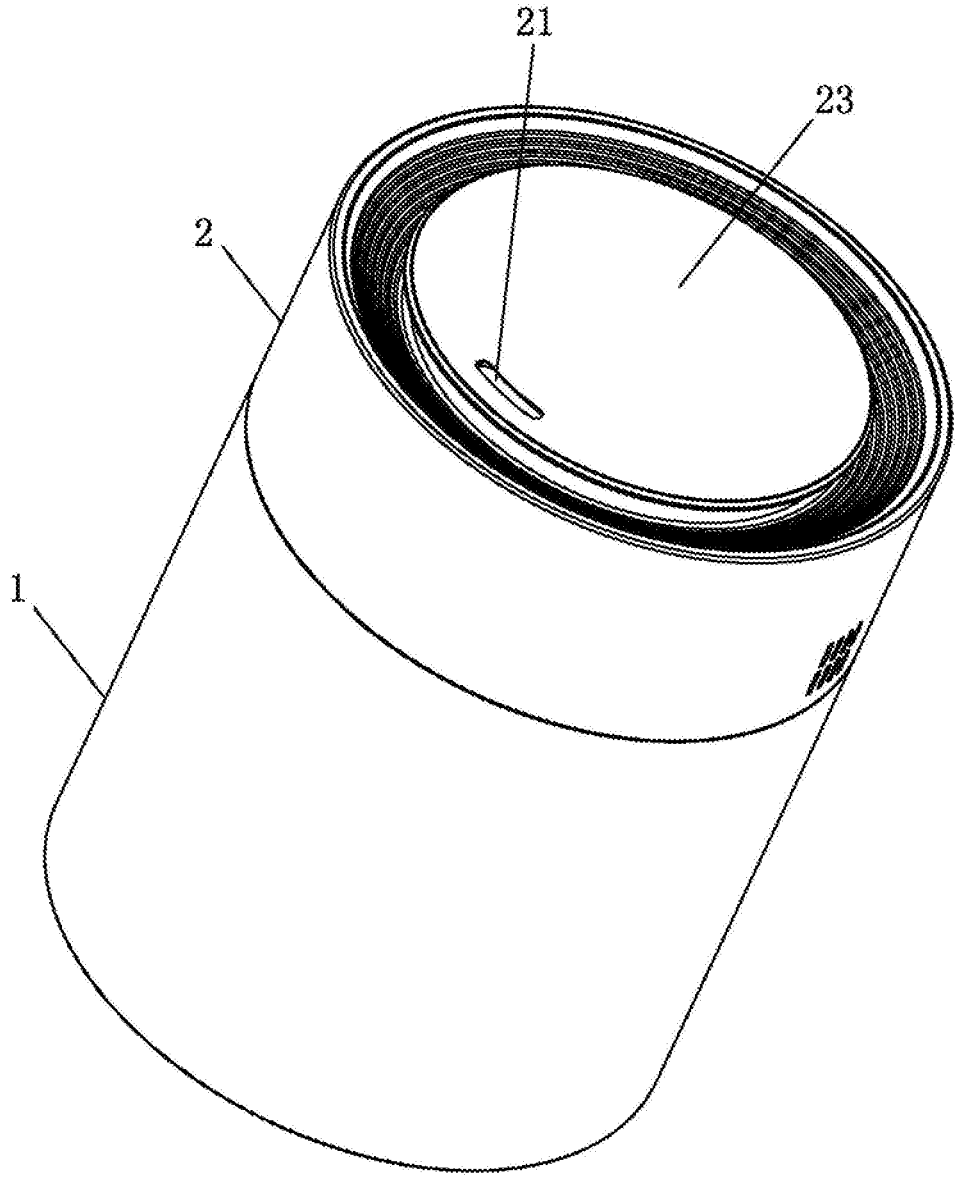
FIG. 3 is the space diagram of embodiment 1 in the invention.

As shown in FIG. 1-3, a submersible-type humidifier that adding water from upper portion, comprising a lower water tank 1 and a top cover 2 connected thereto, the lower water tank 1 and the top cover 2 are detachably connected, wherein an electric appliance chamber used for assembling electrical components is arranged in inner chamber of the top cover 2, an air blower 3 and a display control panel 4 are arranged inside the electric appliance chamber, an energy gathering atomization pipe 5 is provided on bottom of the top cover 2, an ventilation portion 51 is provided on outer side of the energy gathering atomization pipe 5, the air blower 3 is connected to the ventilation portion 51, when the water mist rises to the position of the ventilation portion 51, it will continue to rise under the action of the airflow generated by the air blower 3, an inner chamber of the energy gathering atomization pipe 5 is respectively connected with the ventilation portion 51 and mist outlet 21 of the top cover 2, an atomization component 6 is provided on bottom of the energy gathering atomization pipe 5, the atomization component 6 and the air blower 3 are respectively electrically connected to the display control panel 4, the air blower 3 and the display control panel 4 are arranged in the electric appliance chamber of the top cover 2 to avoid water leakage from the inside of the lower water tank 1 to the inside of the electric appliance chamber, and additional waterproofing work is not required between the top cover 2 and the lower water tank 1, which reduces the production cost, the lower water tank 1 can be fed with water or washed directly by opening the top cover 2, and the invention is convenient and also durable, simultaneously, the lower water tank 1 is not connected with any electrical components, thereby no welding is required, moreover, the invention has a simple structure, and can be used for other storage purposes when it is idle;

the electrical connection between the atomization component 6 and the display control panel 4 can be achieved by arranging a wire chamber on outer side of the energy gathering atomization pipe 5, which can be understood by those skilled in the art, certainly, the wire for connecting the atomization component 6 and the display control panel 4 can be arranged in other positions that do not affect the conductive performance, which is not limited here, also, the atomization component 6 can be an ultrasonic atomization device, which is the prior art and can be understood by those skilled in the art, thereby there is no more detailed description in the invention.

Further, an air inlet connected to the air blower 3 is provide on top of the ventilation portion 51, and an airflow guide slope 511 is provided on bottom of the ventilation portion 51, the airflow generated by the air blower 3 enters the ventilation portion 51 through the air inlet, and enters the inner chamber of the energy gathering atomization pipe 5 more concentratedly under the guidance of the airflow guide slope 511.

Further, an energy gathering floater 7 is arranged in the inner chamber of the energy gathering atomization pipe 5, the energy gathering floater 7 can prevent the water level in energy gathering atomization pipe 5 from being too high and affecting the atomization effect, a mist gathering through hole 71 is arranged at the center of the energy gathering floater 7, the mist gathering through hole 71 can make the water mist more concentrated and improve the atomization effect.

Further, multiple reinforcement ribs 72 are provided on outer lateral wall of the mist gathering through hole 71, which can improve the structural strength of the energy gathering floater 7 to prevent breakdown by ultrasound.

Further, a bell mouth 22 connected to the energy gathering atomization pipe 5 is provided on the top cover 2, the width of the bell mouth 22 increases from bottom to top, thereby the mist is more widespread, a mist outlet cover 23 is provided on upper end of the top cover 2, the mist outlet cover 23 is connected to the bell mouth 22, an energy gathering ring 231 is provided on bottom of the mist outlet cover 2 and the energy gathering ring 231 is in an arc shape with downward opening, a mist outlet gap is formed between the energy gathering ring 231 and the bell mouth 22, the mist outlet 21 is arranged on top of the mist outlet cover 23 and is connected with the mist outlet gap, thereby can reduce the speed of water mist and make the atomization effect softer.

Further, a shunt ring 232 is provided at the center of lower end of the energy gathering ring 231, and multiple shunt holes 233 are provided on the shunt ring 232, part of the water mist will enter the shunt ring 232 and then flow from the shunt holes 233 to the mist outlet gap, thereby the atomization effect is softer.

Further, the lower water tank 1 and the top cover 2 are both in the shape of cylinder.

Embodiment 2

Figure 4:
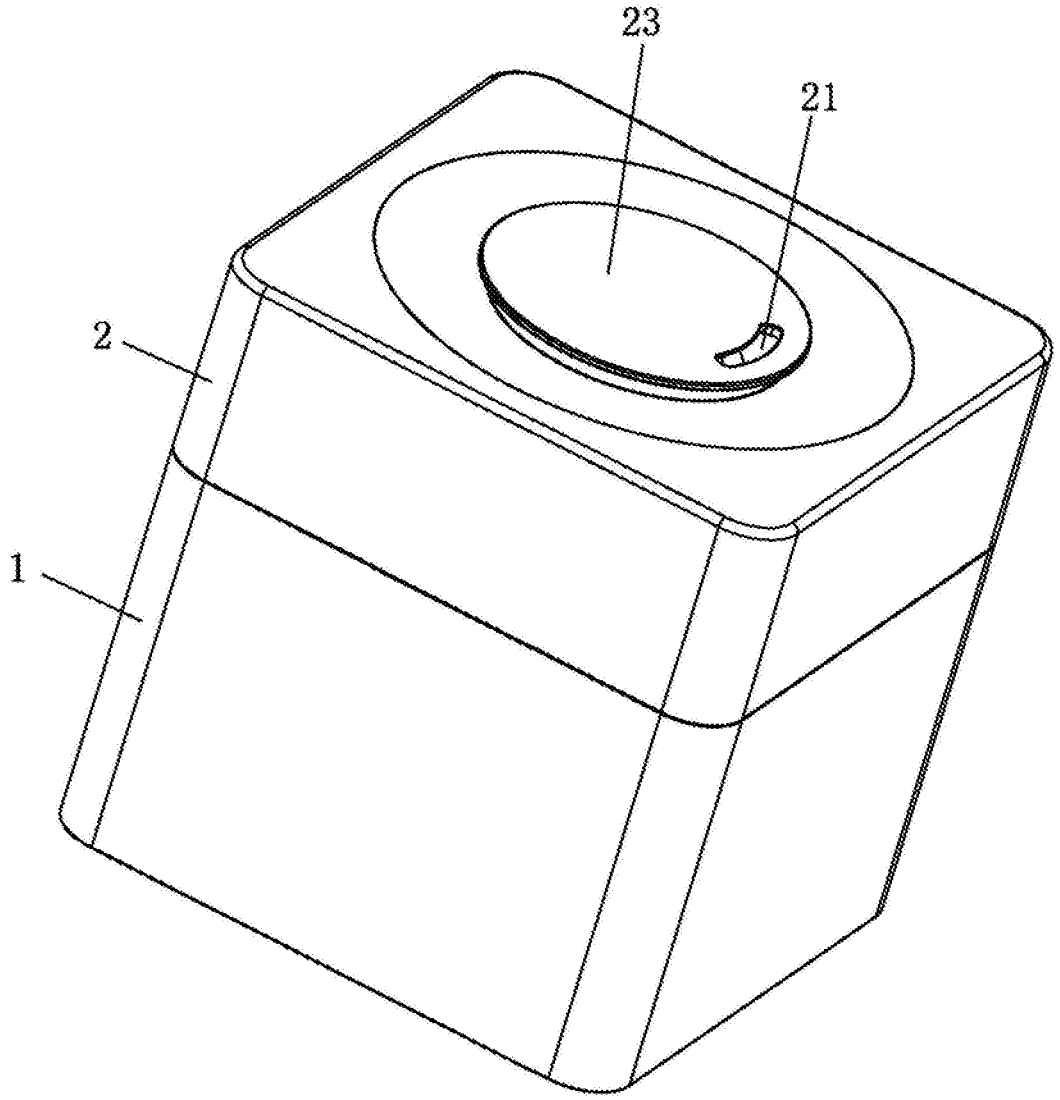
FIG. 4 is the space diagram of embodiment 2 in the invention.

As shown in FIG. 4, the difference between the embodiment and the embodiment 1 is that the lower water tank 1 and the top cover 2 of the submersible-type humidifier that adding water from upper portion are both in the shape of cube.

The rest undescribed parts are the same as in the embodiment 1, and will not be repeated.

The embodiments described above are only preferred solutions of the invention, and the invention can also have other embodiments. Those skilled in the art can also make equivalent modifications or replacements without departing from the spirit of the invention, and the equivalent modifications or replacements are all included in the scope set by the claims of the invention.

The invention claimed is:

1. A submersible-type humidifier with water added from an upper portion, comprising:

a lower water tank;

a top cover connected thereto, wherein the lower water tank and the top cover are detachably connected;

an electric appliance chamber for assembling electrical components, wherein the electric appliance chamber is arranged in an inner chamber of the top cover;

an air blower and a display control panel arranged inside the electric appliance chamber;

an energy gathering atomization pipe provided on a bottom of the top cover;

a ventilation portion provided on an outer side of the energy gathering atomization pipe, wherein the air blower is connected to the ventilation portion, an inner chamber of the energy gathering atomization pipe is respectively connected with the ventilation portion;

a mist outlet of the top cover;

an atomization component provided on a bottom of the energy gathering atomization pipe, wherein the atomization component and the air blower are respectively electrically connected to the display control panel;

a bell mouth connected to the energy gathering atomization pipe and provided on the top cover, wherein a width of the bell mouth increases from bottom to top;

a mist outlet cover provided on an upper end of the top cover, wherein the mist outlet cover is connected to the bell mouth;

an energy gathering ring provided on a bottom of the mist outlet cover, wherein the energy gathering ring is in an arc shape with downward opening;

a mist outlet gap formed between the energy gathering ring and the bell mouth, wherein the mist outlet is arranged on a top of the mist outlet cover and is connected with the mist outlet gap;

a shunt ring provided at a center of a lower end of the energy gathering ring; and multiple shunt holes provided on the shunt ring.

2. The submersible-type humidifier with water added from the upper portion of claim 1, wherein an air inlet connected to the air blower is provide on a top of the ventilation portion, and an airflow guide slope is provided on a bottom of the ventilation portion.

3. The submersible-type humidifier with water added from the upper portion of claim 1, wherein an energy gathering floater is arranged in the inner chamber of the energy gathering atomization pipe, and a mist gathering through hole is arranged at a center of the energy gathering floater.

4. The submersible-type humidifier with water added from the upper portion of claim 3, wherein multiple reinforcement ribs are provided on an outer lateral wall of the mist gathering through hole.

5. The submersible-type humidifier with water added from the upper portion of claim 1, wherein the lower water tank and the top cover are both in a shape of cylinder.

6. The submersible-type humidifier with water added from the upper portion of claim 1, wherein the lower water tank and the top cover are both in a shape of cube.

* * * * *